US008172607B2

(12) United States Patent
Chiapuzzi

(10) Patent No.: US 8,172,607 B2
(45) Date of Patent: May 8, 2012

(54) ELECTRONIC TORQUE WRENCH WITH REMOVABLE BATTERY AND SYSTEM WITH SUCH A WRENCH

(75) Inventor: Angelo Chiapuzzi, Noviglio (IT)

(73) Assignee: Atlas Copco BLM S.r.l., Paderno Gugnano Mi (IT)

( * ) Notice: Subject to any disclaimer, the term of this patent is extended or adjusted under 35 U.S.C. 154(b) by 0 days.

(21) Appl. No.: 12/736,902

(22) PCT Filed: May 18, 2009

(86) PCT No.: PCT/IB2009/005646

§ 371 (c)(1),
(2), (4) Date: Jan. 21, 2011

(87) PCT Pub. No.: WO2009/141705

PCT Pub. Date: Nov. 26, 2009

(65) Prior Publication Data

US 2011/0132155 A1 Jun. 9, 2011

(30) Foreign Application Priority Data

May 21, 2008 (IT) ..... MI2008U0171

(51) Int. Cl.
*B25B 23/144* (2006.01)

(52) U.S. Cl. ..... 439/577; 81/479; 81/483

(58) Field of Classification Search ..... 81/479, 81/467, 483; 439/577, 500
See application file for complete search history.

(56) References Cited

U.S. PATENT DOCUMENTS

| | | | | |
|---|---|---|---|---|
| 3,526,030 | A | 9/1970 | Maropis | |
| 7,114,824 | B2 * | 10/2006 | Picone | 362/119 |
| 7,313,990 | B1 | 1/2008 | Shiao | |
| 2003/0011245 | A1 | 1/2003 | Fiebig | |
| 2006/0042571 | A1 * | 3/2006 | Panasik et al. | 123/46 H |
| 2007/0051186 | A1 | 3/2007 | Gharib | |
| 2008/0196256 | A1 * | 8/2008 | Gieske et al. | 30/277.4 |
| 2008/0215056 | A1 * | 9/2008 | Miller et al. | 606/80 |

FOREIGN PATENT DOCUMENTS

| | | | |
|---|---|---|---|
| DE | 36 07 363 | A1 | 9/1987 |
| EP | 1 559 511 | A | 8/2005 |
| WO | WO 01/73917 | A | 10/2001 |

OTHER PUBLICATIONS

PCT Search Report dated Sep. 3, 2009.

* cited by examiner

*Primary Examiner* — Gary F. Paumen

(74) *Attorney, Agent, or Firm* — Hedman & Costigan, P.C.; James V. Costigan

(57) ABSTRACT

An electronic torque wrench (10) comprises a hand grip body (11) equipped with a user interface (12), electronics (13) for controlling the wrench, a grasping area (18) and power supply batteries. The hand grip body projects out at the front with a mechanical connecting element (14) which ends at one extreme with a clamping head (16), whereas at the rear end it is equipped with a removable battery element (19) which is connected to the hand grip body through a connector group (20) for electric and mechanical connection. When the battery element (19) is removed, a connector (20*a*) is uncovered at the rear end of the hand grip body (11) for the connection of the wrench to a matching connector (20*c*) of an electric cable (21) for connecting to an external unit (22) for supplying power to the wrench and controlling it.

5 Claims, 1 Drawing Sheet

ELECTRONIC TORQUE WRENCH WITH REMOVABLE BATTERY AND SYSTEM WITH SUCH A WRENCH

The present finding refers to an electronic torque wrench system and to an electronic torque wrench of the type comprising an elongated hand grip body from one end of which a connection element protrudes ending with the clamping head. The hand grip body has a grasping area and a display and command interface. The wrench is usually supplied with power through an internal, preferably rechargeable, battery. In known wrenches, since the battery is inserted inside the hand grip body, the weight distribution is not optimal for the manoeuvring of the wrench. Moreover, the removal and replacement of the battery, when it is possible, is often difficult. The connection with other power supplying sources or external command units is also often difficult, because the connection cable puts the wrench out of balance and hinders its manoeuvring.

The general purpose of the present finding is that of providing an innovative wrench system and an innovative wrench structure that allow the battery to be removed easily and make the wrench easy to use both with the power supply battery as well as with the cable for connecting to external units. For this purpose it has been thought of, according to the finding, to make an electronic torque wrench comprising a hand grip body equipped with a user interface, with wrench control electronics and with a grasping area, the hand grip body projecting out at the front with a mechanical connecting element which ends at one extreme with a clamping head, characterized in that a removable battery element for supplying power to the wrench by battery, axially protrudes out from the bottom extreme of the hand grip body, opposite the clamping head, and it is connected to the hand grip body through a connector group for electric and mechanical connection, a connector, once the battery element is removed, being uncovered at the rear end of the hand grip body for the connection of the wrench to a matching connector of an electric cable for connecting to an external power supply and control unit.

Again according to an aspect of the finding, an electronic torque wrench system comprising an external power supply and control unit and an electronic torque wrench, the wrench comprising a hand grip body equipped with a user interface, with electronics for controlling the wrench and with a grasping area, the hand grip body projecting out in front with a mechanical connecting element which ends at one extreme with a clamping head, a removable battery element for supplying power to the wrench by battery protruding out axially from the rear end of the hand grip body, opposite the clamping head, and it is connected to the hand grip body through a connector group for electrical and mechanical connection, a connector, once the battery element is removed, being uncovered at the rear end of the hand grip body for the connection of the wrench to a matching connector of an electric cable for connecting to an external power supply and control unit of the wrench.

In order to clarify the explanation of the innovative principles of the present finding and its advantages compared to the prior art, in the rest of the description, with the aid of the attached drawings, a possible embodiment shall be described in which these principles are applied. In the drawings.

Figure 1:
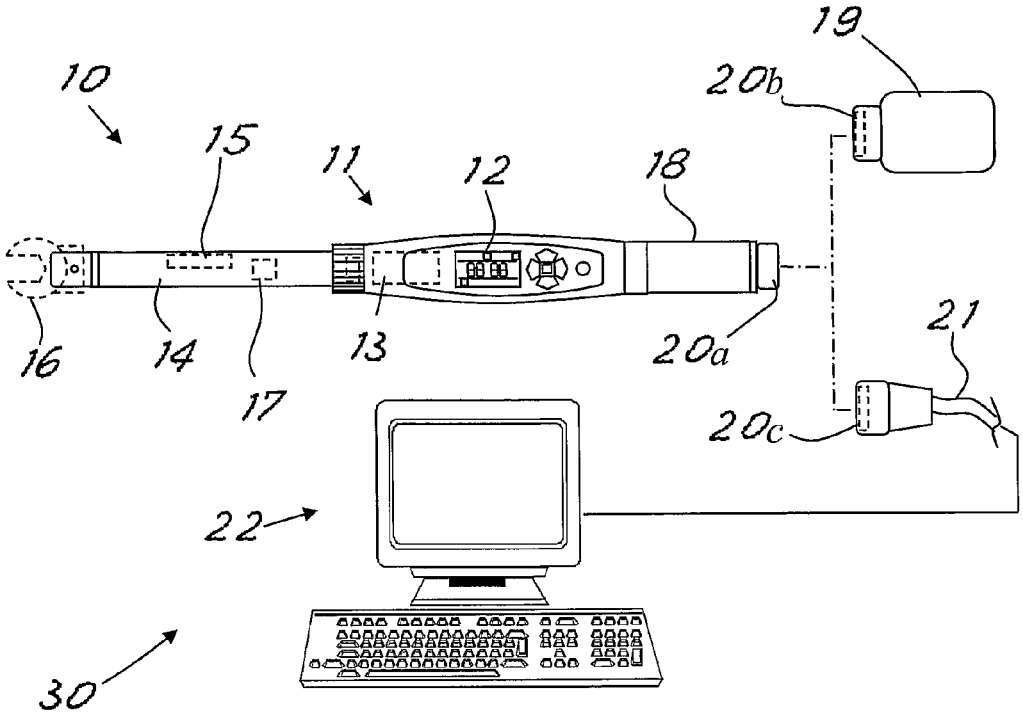
FIG. 1 represents a schematic view of a system with the torque wrench according to the finding.

With reference to the figures, in FIG. 1 an electronic torque wrench is shown generically indicated with 10. The wrench comprises a hand grip body 11 equipped with a user interface 12 and with electronics for controlling the wrench 13.

The control electronics are of the per se known type (for example, using a suitably programmed microprocessor) and they shall not be described or shown any further here. As can easily be gathered by a man skilled in the art, the control electronics will show, for example on a suitable display of the user interface, various clamping measurements and parameters, based upon what shall be detected by the sensors of the wrench and upon the operative settings inserted through commands given through the user interface on the body 11 and/or through remote controls received and transmitted through possible external connecting systems.

From the front end of the hand grip body a mechanical connecting element 14 projects, extending it and ending with a suitable clamping head 16, advantageously of the removable and replaceable type according to the elements to be clamped. The connecting element 14 is internally equipped with suitable known sensors 15 for measuring the clamping torque and that are connected to the control electronics 13 for processing and displaying the clamping information. As well as the torque sensors in the wrench there can also advantageously be a known angular rotation sensor 17, also connected to the electronics 13.

The hand grip body 11 has a grasping area 18 for gripping and manoeuvring the wrench. Such a grasping area is advantageously near to the rear end of the hand grip body, opposite the clamping head, and it extends axially to the wrench for an extension suitable for grasping with a hand.

A battery power supplying element 19 projects out axially from the rear end of the hand grip body 11 and contains the suitable rechargeable batteries. Such a battery element 19 is connected to the hand grip body through a connector group 20 for electric and mechanical connection. The connection group consists of a first connector 20*a* on the rear end of the hand grip body and a second connector 20*b*, matching the first, on the battery power supplying element. Advantageously, the connector group is of the axially coupling type with a screw or bayonet type locknut.

Positioning the batteries at the rear end has been found to be advantageous for shifting the weight of the wrench towards the back and obtaining a barycentre of the wrench which allows it to be used more easily. Advantageously, the battery element 19 has a greater diameter than that of the grasping area. This reduces the rear extension and effectively defines the grasping area, stopping the hand from slipping away, from the hand grip.

Figure 2:
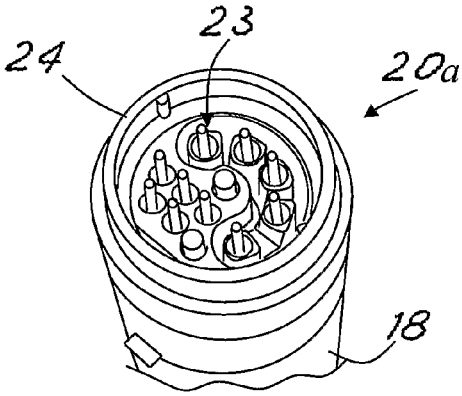
FIG. 2 represents a view of a rear end of the wrench with a multifunctional connector.
Figure 3:
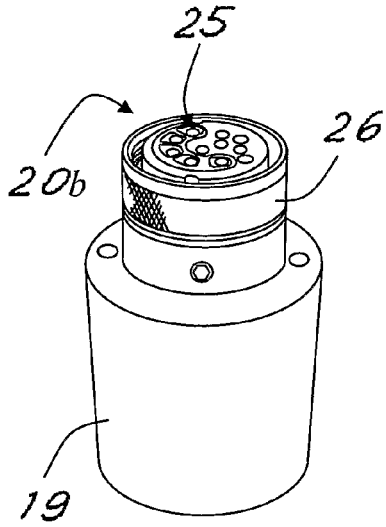
FIG. 3 represents a perspective view of a battery element able to be coupled onto the end of FIG. 2.

Once the power supplying element 19 is removed it uncovers a connector 20*a* at the rear end of the hand grip body which allows the wrench to be connected to a further matching connector 20*c* of an electric cable 21 for connecting to an external power supplying and control unit 22. The external unit is of the per se known type, easily gathered by a man skilled in the art and it allows, for example, data to be received from the wrench (to save it, show it on video or print it) or operative settings to be sent to the wrench. The wrench 10 and the unit 22 with respective accessories, form a torque wrench system generically indicated with 30. FIG. 2 shows an advantageous configuration of the connector 20*a* on the rear end of the wrench. The connector is of the multipolar type, with a plurality of electric connection pins 23 surrounded by a mechanical coupling collar 24. Advantageously, the collar has a diameter roughly equal to that of the grasping area 18.

FIG. 2 shows the battery element 19 with the matching connector 20*b*. The connector 20*b* comprises a plurality of contact seats 25 that axially receive the contact pins 23. A locknut 26 surrounds the contact seats 25 to receive the collar 24 and to couple with it through rotation. For such a purpose, the locknut and collar can be threaded so as to fit together or they can be equipped with suitable known bayonet coupling elements.

The connector 20*c* is not shown in further detail, being of analogous structure as the connector 20*b*. The connector 20*b* can, of course, comprise a smaller amount of active contacts compared to connectors 20*a* and 20*b*.

At this point it is clear how the predetermined purposes have been achieved. The position of the batteries allows the wrench to be manoeuvred easily. The fact that the cable replaces them again projecting at the rear, also maintains a certain balance and manoeuvring of the wrench even with the use of the cable. The replacement of the battery element is easy and fast, so that the down time due to the battery being flat is extremely short.

A connection to an external power supply through the cable 21 allows work to be carried out continuously, without needing to replace the battery. Through the connection cable the wrench can receive both the power supply as well as the programming information and in turn it can transmit the detected measurements in the programmed screwing cycle. Thanks to the opportunity of an easy connection to an external control unit, the torque wrench can be used instead of a screwer connected to a power unit which supplies power to the screwer and programs the screwing. The wrench, with its own suitable resident software is able to receive the programming of the screwer which it has to replace and quickly be prepared to manually carry out the same cycle of programmed work.

Of course, the description above of an embodiment applying the innovative principles of the present finding is shown as an example of such innovative principles and therefore must not be considered to limit the scope of protection claimed here.

The invention claimed is:

1. Electronic torque wrench (10) comprising a hand grip body (11) equipped with a user interface (12), electronics (13) for controlling the wrench and a grasping area (18), the hand grip body projecting out at the front with a mechanical connecting element (14) which ends with a clamping head (16) at one extreme, characterized in that a removable battery element (19) for supplying the wrench with power by battery, protrudes axially from the rear end of the hand grip body, opposite the clamping head, and it is connected to the hand grip body through a connector group (20) for electric and mechanical connection, a connector (20*a*), once the battery element (19) is removed, being uncovered at the rear end of the hand grip body (11) for the connection of the wrench to a matching connector (20*c*) of an electric cable (21) for connecting to an external power supply and control unit (22).

2. Wrench according to claim 1, characterized in that the connector group (20) couples axially with a locknut.

3. Wrench according to claim 1, characterized in that the grasping area (18) is near to the rear end of the hand grip body and the battery element (19) has a greater diameter than that of such a grasping area.

4. Wrench according to claim 1, characterized in that the grasping area (18) is axially located between the user interface (12) and the battery element (19).

5. Electronic torque wrench system (30) comprising an external power supply and control unit (22) and an electronic torque wrench (10), the wrench comprising a hand grip body (11) equipped with a user interface (12), electronics (13) for controlling the wrench and a grasping area (18), the hand grip body projecting out at the front with a mechanical connecting element (14) which ends with a clamping head at one extreme (16), a removable battery element (19) for supplying the wrench with power by battery, projecting axially from the rear end of the hand grip body, opposite the clamping head, and it is connected to the hand grip body through a connector group (20) for electric and mechanical connection, a connector (20*a*), once the battery element (19) is removed, being uncovered at the rear end of the hand grip body (11) for the connection of the wrench to a matching connector (20*c*) of an electric cable (21) for connecting to the external unit (22) for supplying power to the wrench and controlling it.

* * * * *